United States Patent [19]

Prucyk

[11] 4,363,355

[45] Dec. 14, 1982

[54] HEAT EXCHANGER

[76] Inventor: Martin D. Prucyk, Woods Rd, P.O. Box 58, Nobel, Ontario, Canada

[21] Appl. No.: 148,366

[22] Filed: May 9, 1980

[51] Int. Cl.[3] ..... F28F 9/16

[52] U.S. Cl. ..... 165/81; 165/150; 165/163; 165/178; 165/DIG. 13

[58] Field of Search ..... 165/178, 176, 175, 173, 165/69, 158, 163, 70, 150, 151, 152, 172, 83, 81, 163, DIG. 13; 285/189, 286

[56] References Cited

U.S. PATENT DOCUMENTS

| | | | |
|---|---|---|---|
| 1,940,963 | 12/1933 | McIntyre | 165/150 |
| 1,976,102 | 10/1934 | Young et al. | 165/81 |
| 2,056,920 | 10/1936 | Demann | 165/178 |
| 2,064,036 | 12/1936 | Sandberg | 165/150 |
| 2,196,683 | 4/1940 | Pickstone | 165/178 |
| 2,762,611 | 9/1956 | Monroe et al. | 165/173 X |
| 2,950,092 | 8/1960 | Di Niro | 165/150 |
| 3,258,067 | 6/1966 | LaFleur | 165/81 |
| 3,326,279 | 6/1967 | Eisberg et al. | 165/173 |
| 3,440,391 | 4/1969 | Apblett | 165/173 X |

FOREIGN PATENT DOCUMENTS

| | | | |
|---|---|---|---|
| 106102 | 12/1938 | Australia | 165/175 |
| 581085 | 8/1959 | Canada | 165/81 |
| 563894 | 10/1932 | Fed. Rep. of Germany | 165/158 |
| 570559 | 1/1933 | Fed. Rep. of Germany | 165/158 |
| 80593 | 8/1919 | Switzerland | 165/81 |

*Primary Examiner*—Sheldon J. Richter
*Attorney, Agent, or Firm*—Ivor M. Hughes

[57] ABSTRACT

A heat exchanger is provided, comprising a housing defining a cavity therein, the housing having an inlet and outlet for feeding fluid into, and removing fluid from, the cavity of the housing, a pair of fixed spaced head plates fixed to the housing at either end of the cavity to preclude passage of fluid past the plates between the housing and plates, a pair of second head plates, one for each fixed head plate and secured to the side of the fixed head plate remote the other fixed spaced head plate, at least one of which second plates being removably secured to the fixed head plates, a gasket positioned between the fixed head plates and second plates, the housing further comprising covers for covering the head plates and providing a space between the head plates and cover, a pair of spacer plates secured to the housing between the fixed head plates, each spacer plate positioned adjacent each fixed head plate, the spacer plates permitting fluid within the cavity to flow therethrough, each of the fixed and secured removable head plates having a plurality of aligned apertures therethrough, the apertures being arranged in staggered rows of apertures through the plates, each spacer plate adjacent each set of head plates having staggered rows of apertures oriented with respect to the staggered rows of apertures in the head plates and the staggered row of apertures through the other spacer plate to secure lengths of tubing extending between opposed head plates, through apertures in the spacer plates, lengths of heat conducting metal tubing secured to open into the staggered apertures in the opposed head plates and extending through the apertures in the spacer plates, to provide staggered rows of tubing, the tubing being bowed in their length between the spacer plates to extend into spaces created in the cavity arising from the staggering of the rows of tubing, 180° heat conducting metal U-Bends secured in the spaces between the removably secured head plates and cover for connecting the apertures through the removable head plates to connect the lengths of tubing to create a continuous flow path for fluid passing therethrough, from the tubing inlet to the tubing outlet leading into and out of the heat exchanger and an inlet and outlet into and from the tubing passing through the exchanger.

30 Claims, 16 Drawing Figures

HEAT EXCHANGER

FIELD OF INVENTION

This invention relates to heat exchangers and particularly heat exchangers used to heat paint in hot line pavement striping systems.

BACKGROUND OF THE INVENTION

In my U.S. patent application Ser. No. 865,591 I disclosed a heating system for mounting on a truck for heating paint "hot" employing the exhaust gases of the truck engine and compressor engine mounted on a truck to heat the paint. The exhaust gases were first collected and then fed through the heat scavenger for heat extraction. It was there that the heat from the exhaust gases was conducted through the tube walls of the scavenger to heat the thermal oil bath surrounding the tubes of the scavenger. The heated oil (in order of about 150° C.) was then passed to the heat exchangers for passing the contained heat through the tube walls to heat the paint. Because the paint is heated from ambient (storage temperature) to 72° C., (discharge temperature) in a very short time interval, during which the paint is passing through the paint tubing in the heat exchanger, it is imperative that maximum heat be injected through the tube wall into the paint. To this end, the tubing was coiled to provide a longer paint path through the exchanger for greater heat transfer prior to discharge, giving rise to new problems resulting from the coiling. Unless the heated paint is circulated continuously the paint will stagnate and plug the coil requiring removal of the coil for cleaning or replacement. Additionally, the coils expand unevenly in all directions when heated, making undesirable contact with adjacent coil sections where the number of coils is maximized.

It is therefore an object of this invention, to provide a heat exchanger which overcomes the aforementioned problems, being easily cleaned when necessary and being constructed to preclude paint tubing contact.

It is a further object of this invention, to provide a heat exchanger which has increased heat transfer abilities for faster heating of the paint.

Further and other objects of the invention will be realized by those men skilled in the art from the following summary of the invention and detailed description of a preferred embodiment thereof.

SUMMARY OF THE INVENTION

According to one aspect of the invention, an improved heat exchanger is provided, comprising a housing defining a cavity therein, the housing having an inlet and outlet for feeding fluid into, and removing fluid from, the cavity of the housing, a pair of fixed spaced heat plates fixed to the housing at either end of the cavity to preclude passage of fluid past the plates between the housing and plates, a pair of second head plates, one for each fixed head plate and secured to the side of the fixed head plate remote the other fixed spaced head plate, at least one of which second head plates and preferably both such plates, being removable secured to the fixed head plates, a gasket positioned between the fixed head plates and second plates, the housing further comprising covers for covering the head plates and providing a space between the head plates and cover, a pair of spacer plates secured to the housing between the fixed head plates, each spacer plate positioned adjacent each fixed head plate, the spacer plates permitting fluid within the cavity to flow therethrough, each of the fixed and secured removable head plates having a plurality of aligned apertures therethrough, the apertures being arranged in staggered rows of apertures through the plates, each spacer plate adjacent each set of head plates having staggered rows of apertures oriented with respect to the staggered rows of apertures in the head plates and the staggered row of apertures through the other spacer plate to secure lengths of tubing extending between opposed head plates, through apertures in the spacer plates, lengths of heat conducting metal (preferably copper or copper alloy) tubing secured to open into the staggered apertures in the opposed head plates and extending through the apertures in the spacer plates, to provide staggered rows of tubing, the tubing being bowed in their length between the spacer plates to extend into spaces created in the cavity arising from the staggering of the rows of tubing, so as not to interfere with one another during the tubings' expansion 180° heat conducting metal U-Bends (preferably copper or copper alloy U-bends) secured in the spaces between the removably secured head plates and cover for connecting the apertures through the removable head plates to connect the lengths of tubing to create a continuous flow path for fluid passing therethrough from the tubing inlet to the tubing outlet leading into and out of the heat exchanger, and an inlet and outlet into and from the tubing passing through the exchanger.

Where only one of the second head plates is removably secured, the bottom second plate is preferably the removable second head plate.

Preferably the tubing and U-bends are silver soldered to the head plates. Preferably, the tubing is silver soldered to the spacer plates and preferably only along an arcuate portion of the circumference of the tubing passing through respective apertures in the spacer plates.

In use, the heat exchanger heats the paint to be discharged relatively quickly to the desired temperature. When in need of cleaning, the removable second plates are removed exposing the tubes for cleaning. Where only one plate is removable, flexible pipe cleaners are inserted up one tube, through the U-bend and the other connecting tube and worked back and forth to remove the paint residue in the tubing.

The invention will now be illustrated with reference to the following drawings of a preferred embodiment of the invention and the detailed description of the preferred embodiment of the invention that follows.

DETAILED DESCRIPTION OF THE PREFERRED EMBODIMENT

Figure 1:
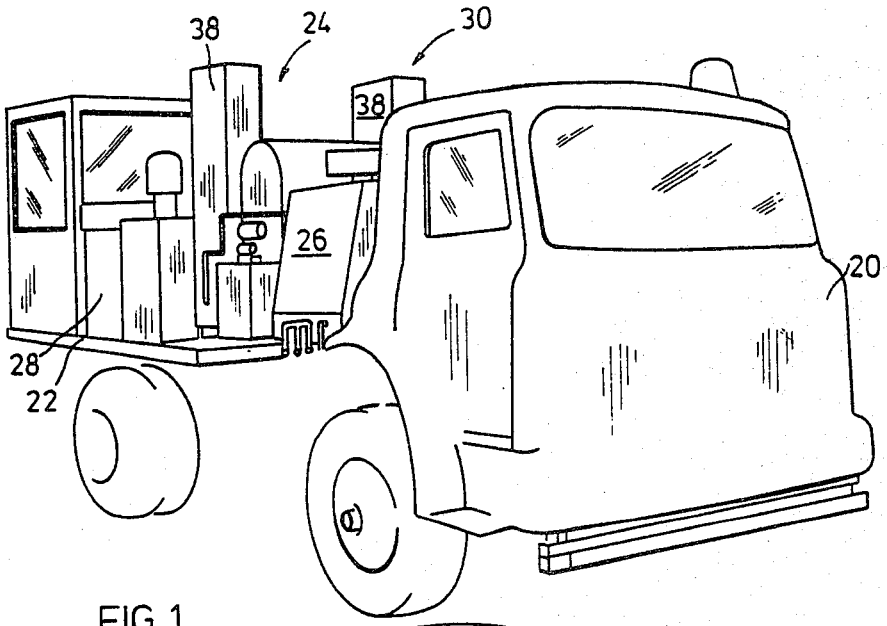
FIG. 1 is a perspective view of a truck mounting a paint heating system incorporating heat exchangers according to a preferred embodiment of the invention.

With reference to FIG. 1, there is shown truck 20, (C-900 Ford (t.m.) tilt cab) having a 477 cubic inch internal combustion engine (not shown) and trailer platform 22 mounting hot line pavement striping system generally indicated at 24 and comprising Hercules (t.m.) compressor 26 having a four cylinder internal combustion engine (not shown), paint storage tanks, one of which is shown at 28, a paint heating system generally shown at 30 (see also FIG. 2) comprising a heat scavenger 32 for extracting heat from the exhaust gases (collected from the internal combustion engines and passed through smaller tubes 34 of scavenger 32) and transmitting the heat through the walls of tubes 34 to the thermal oil bath 36 surrounding tubes 34, heat exchangers 38 through which the heated oil is pumped by pump 40 and returned cooler to scavenger 32 for reheating and recirculation after heating paint "hot" passing through heat exchangers 38 from storage tanks 28 prior to discharge at the paint guns (not shown); pumps (not shown) for pumping the paint from storage through heat exchangers 38 for heating prior to discharge by the paint guns (not shown), and, accummulators (not shown) for accummulating paint prior to discharge by the guns.

Figure 3:
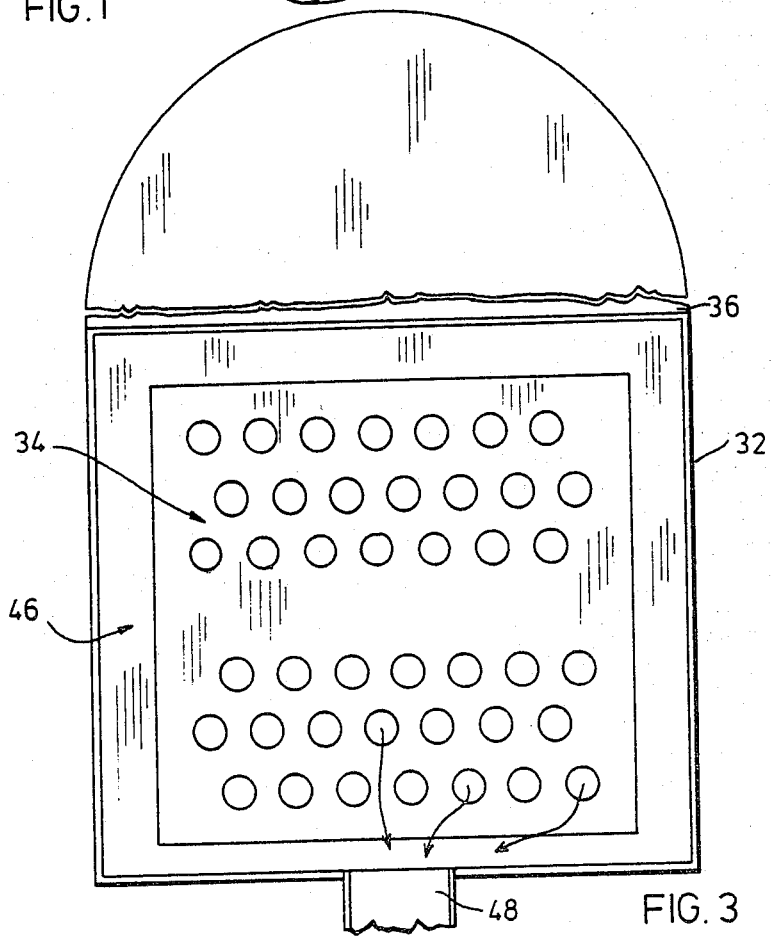
FIG. 3 (found with FIG. 1) is an elevation of part of the heating system of FIG. 2.
Figure 2:
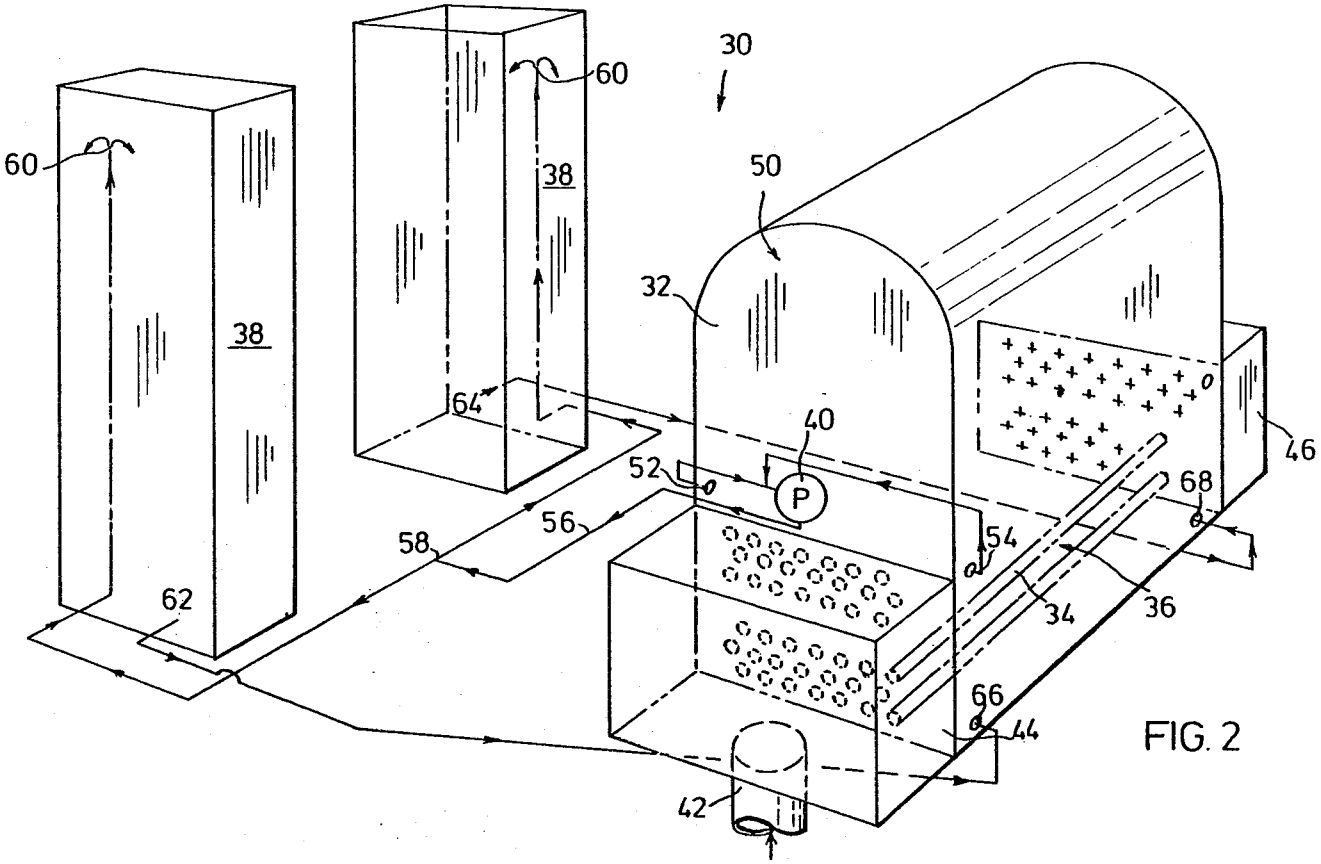
FIG. 2 is a schematic illustrating the heating system incorporating heat exchangers according to the preferred embodiment of the invention.

With reference to FIG. 2, exhaust gases from the internal combustion engines (not shown) are collected and fed by tube 42 into anti-chamber 44 into which tubes 34 open, through tubes 34 extending through the bottom portion of scavenger 32, into exhaust chamber 46 (See FIG. 3) and exhausted to atmosphere through conduit 48. Thermal oil in cavity 50 within scavenger 32 surrounding tubes 34 is heated to a temperature of 150° C. by heat conducted through the tube walls of tubes 34. The heated oil is removed at outlets 52 and 54 and circulated by pump 40 via stream 56 through "Y" connection 58 appropriately valved to feed at one time either or both heat exchangers 38 with heated oil through inlets 60. Cooler oil is returned from outlets 62 and 64 to scavenger 32 through inlets 66 and 68 respectively for reheating.

Figure 4:
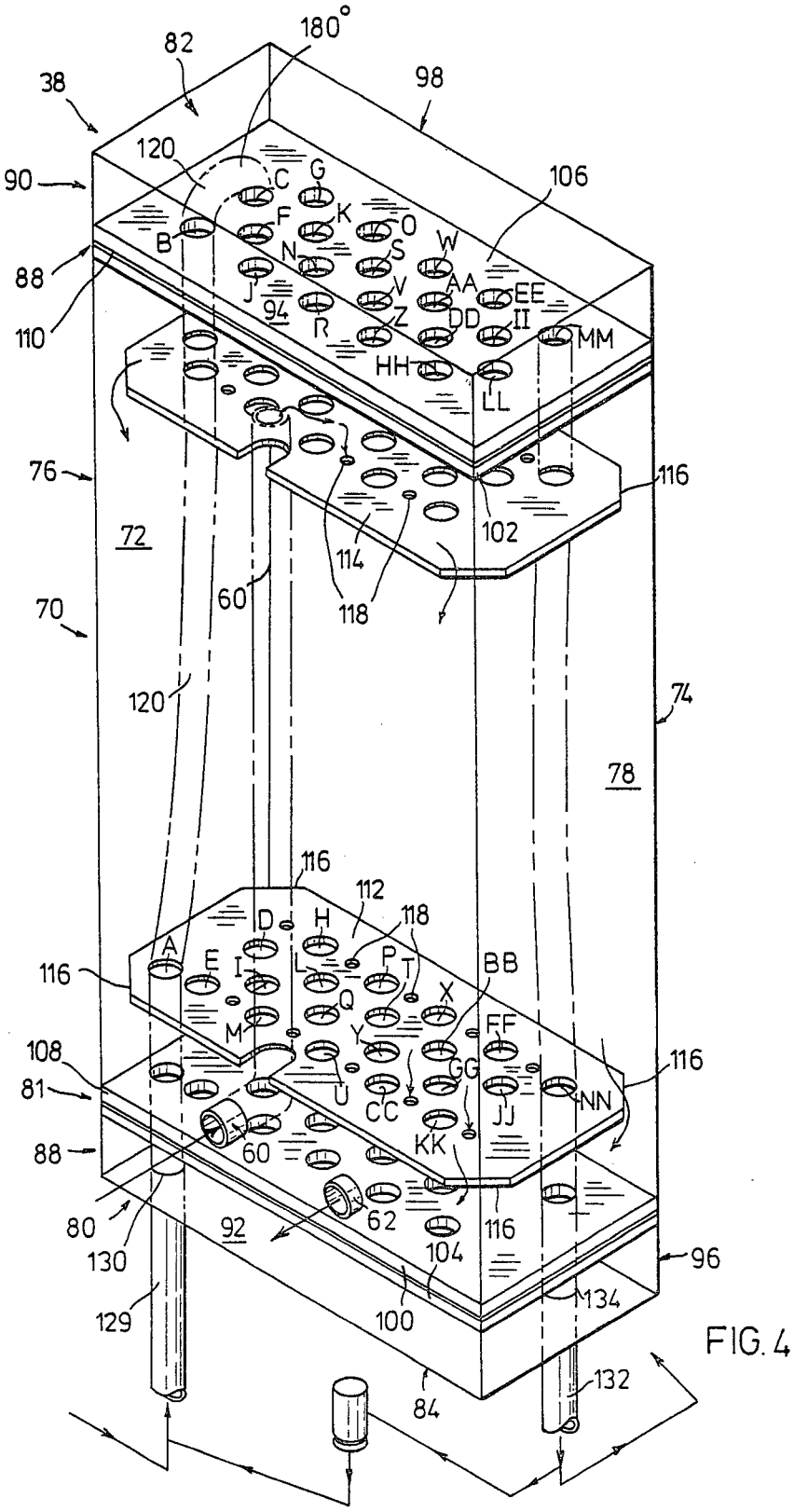
FIG. 4 is a partial perspective view illustrating component parts of the heat exchangers incorporated into the heating system according to the preferred embodiment of the invention.

With reference to FIG. 4, exchanger 38 comprises sheet metal housing 70 rectangular in cross-section having front and back walls 72 and 74, side walls 76 and 78, and bottom and top covers 80 and 82 for closing ends 81 and 83 respectively, of housing 70. Rectangular in cross-section, covers 80 and 82 comprise end walls 84 and 86, depending side walls 88 and 90, depending front walls 92 and 94, and depending back walls 96 and 98, respectively.

Welded within housing 70 at both ends 81 and 83 are fixed rectangular steel head plates 100 and 102, each being ¾" and fully welded around the periphery to walls 72, 74, 76 and 78 so that no fluid passes the sides of the plate past the welds. Bottom head plate 100 has four staggered rows of five apertures (or bore holes) per row, passing through the plate. Top head plate 102 has four staggered rows of apertures or bore holes also passing through the plate, the row closest front wall 72, having six apertures, the next adjacent row-four, the next-five, and the last, closest back wall 74-five.

Secured on the sides of head plates 100 and 102 remote the other plate are removably securable second head plates 104 and 106 respectively secured by threaded bolts (not shown) through bolt holes (not shown) through gaskets 108 and 110 made of a mixture of asbestos and vitron rubber into threaded bores (not shown). Both plates 104 and 106 and gaskets 108 and 110 have staggered rows of apertures therethrough aligned with the rows of apertures in fixed head plates 100 and 102 respectively.

Spacer plates 112 and 114 are welded to housing walls 72, 74, 76 and 78 and include, staggered rows of apertures therethrough corresponding to those through plates 100 and 102, notched corners 116 for the passage of fluid and fluid passageways 118 therethrough.

Paint passage through heat exchangers 70 has been facilitated by the use of lengths of bowed copper pipes 120° and 180° ¾" copper U-bends 122 connected to the fixed and securably removable head plates to form a continuous passageway through which the paint will travel for heating prior to discharge at the paint guns.

Figure 5:
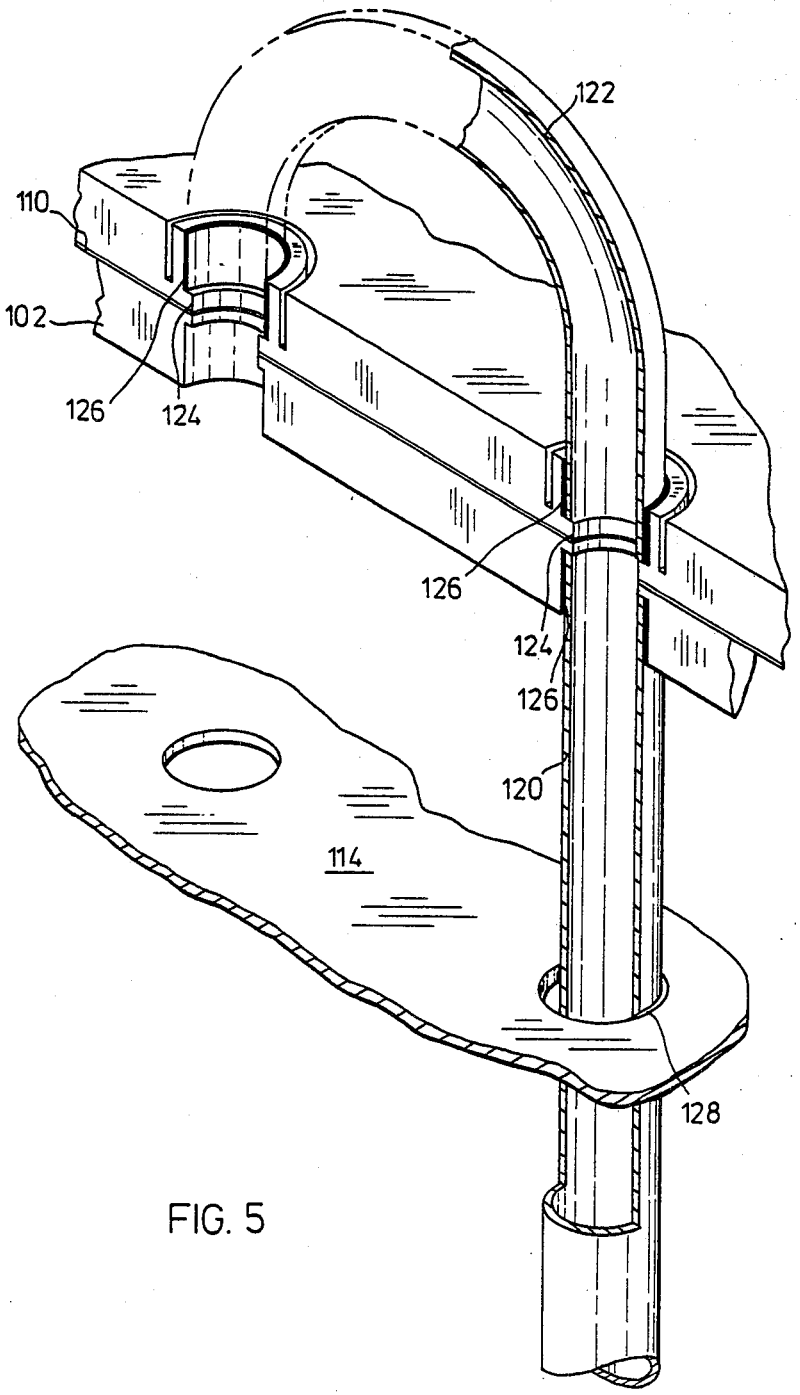
FIG. 5 is a perspective cross-sectional view of some of the components of the heat exchanger shown in FIG. 4.
Figure 5C:
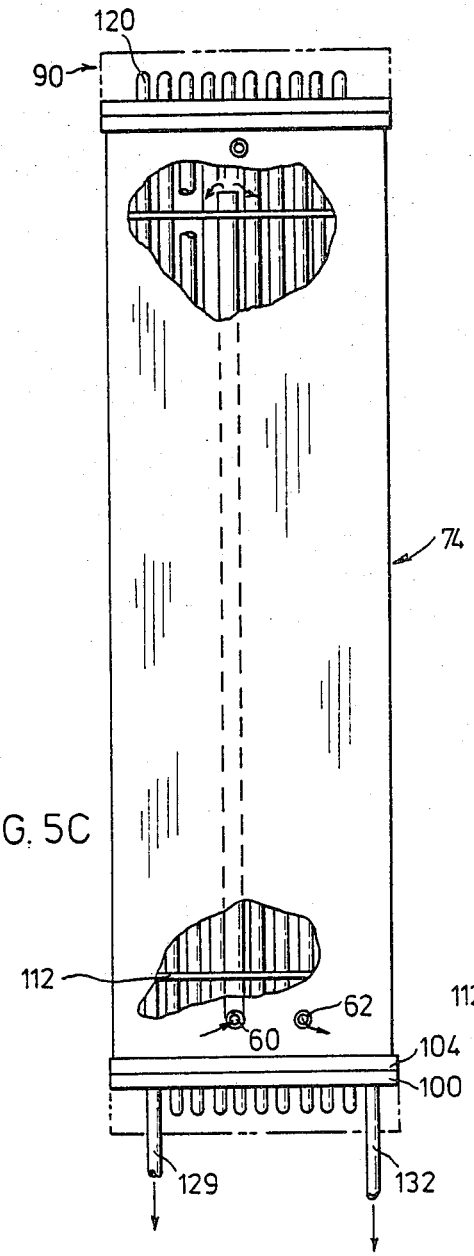
FIGS. 5A, 5B and 5C illustrate the top, side and front views of the heat exchanger.
Figure 5B:
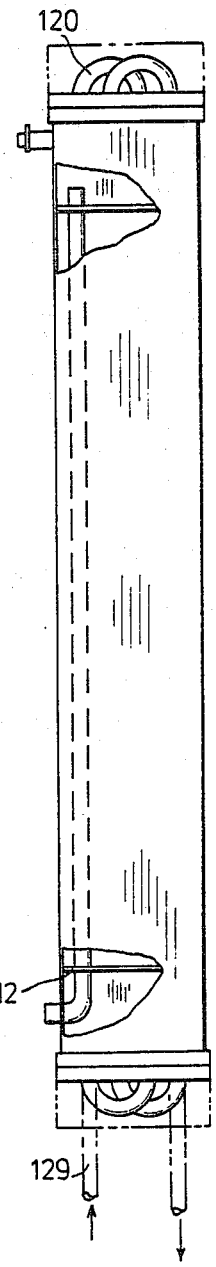
Figure 5A:
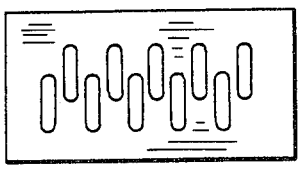
Figure 6B:
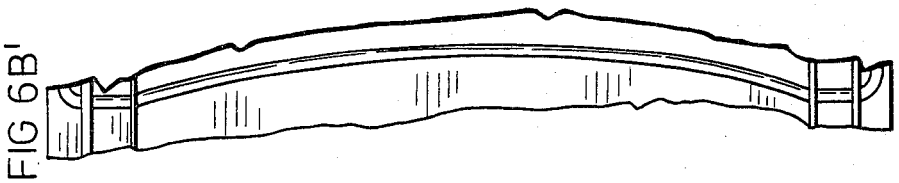
FIGS. 6A, 6A[1], 6B, 6B[1], 6C, 6C[1] 6D and 6D[1] illustrate front and side views of the orientation of tubing in the heat exchangers according to the preferred embodiment of the invention.
Figure 6B:
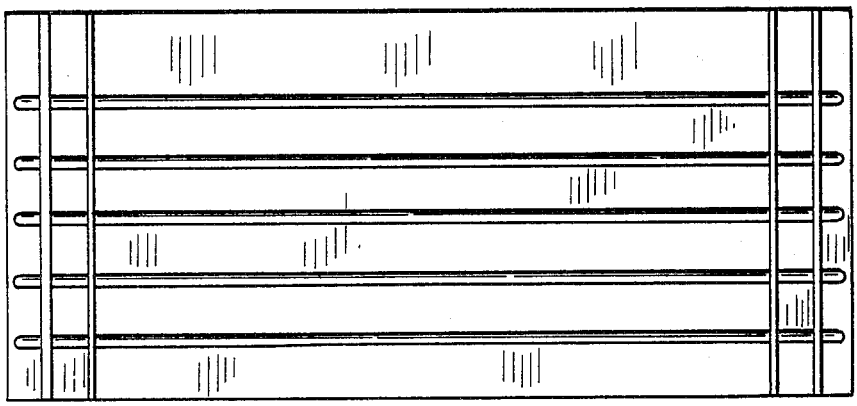
Figure 6A:
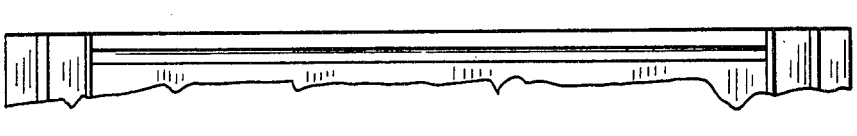
Figure 6A:
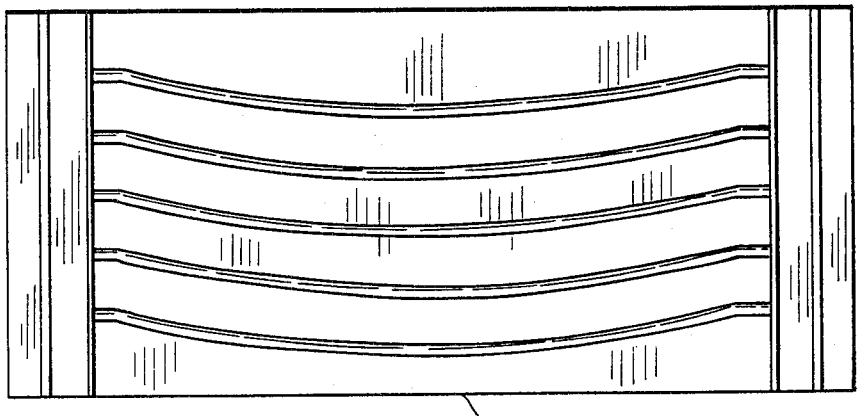
Figure 6D:
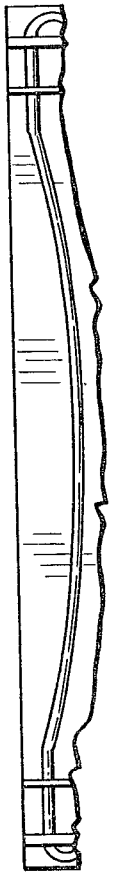
Figure 6D:
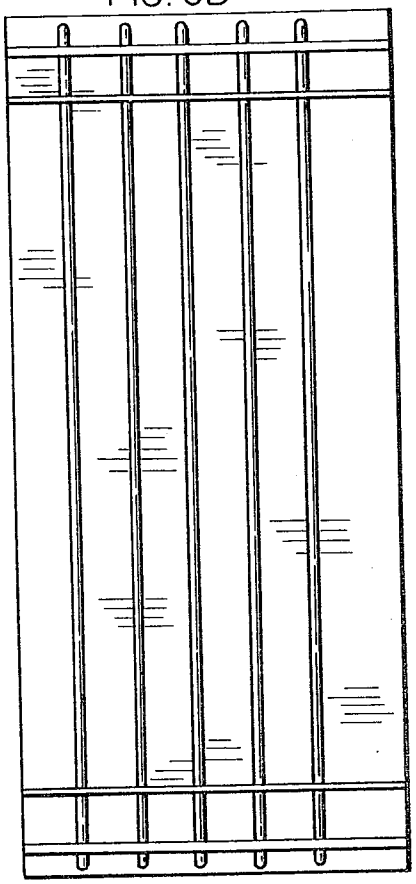
Figure 6C:
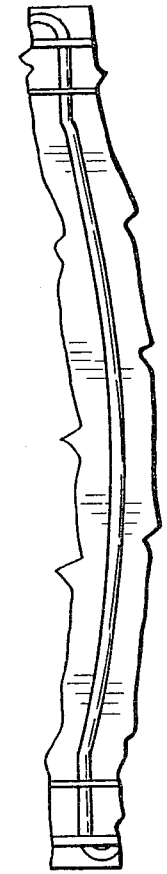
Figure 6C:
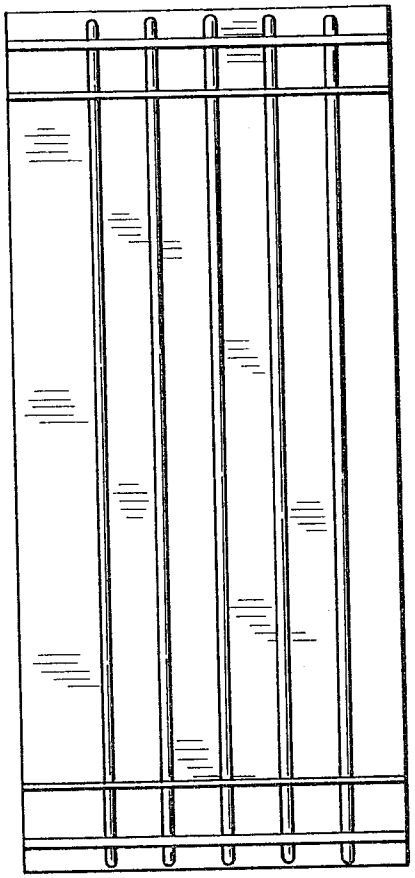

With reference to FIG. 5, a cross-sectional view of the connection of the pipe 120° and 180° U-bends 122 to the plates is shown. Particularly each aperture (or bore hole) through each plate has an annular ledge 124 proximate the side surface of the plate nearest the other plate of a width corresponding to the thickness of the pipe wall or U-bend wall for seating the end of the pipe or U-bend thereagainst when each has been secured in each aperture.

Because of the extremes of temperatures within which the joints between the pipes and plate and U-bend and plate must endure, pipes 120 and U-bends 122 are silver soldered within the plate apertures to the respective plate as at 126 to seat against ledges 124. Lengths of pipe extend between fixed plates 100 and 102 through aligned apertures in the spacer plates to which an arcuate portion of the outer surface of each pipe is silver soldered adjacent one side of each aperture as for example at 128 of spacer plate 114. Therefore, the lengths of pipe between the fixed and spacer plates, are rigidly secured to preclude movement therebetween. However, because of the greater distance between the spacer plates than between the fixed plates and spacer plates, any movement of the tubing covered by expansion and contraction occurs between the spacer plates.

With reference to FIG. 4, the apertures to which the lengths of pipe 120 and U-bends 122 are joined to form the continuous passageway for the paint are identified in alphabetical order, with aligned apertures in the fixed and securably removable spacer plates being identified with the same letter. Because FIG. 4 does not show all apertures (bore holes) in plates 100 and 104, the corresponding aligned apertures in spacer plate 112 are identified with the letter.

Inlet pipe 129 enters housing 70 at 130 and is secured in apertures A in plate 100. Pipe 120A secured to plate 104 in aperture A extends through aperture A in spacer plate 112, through apertures B in spacer 114 and fixed plate 102 and is silver soldered in aperture B of fixed plate 102 to the edge. U-bend 122 extends from aperture B in which it is silver soldered to plate 106 into aperture C whereat it is secured by silver soldering. A length of pipe 120 is secured in aperture C of fixed plate 103, and extends through aperture C in spacer plate 114, through aperture D of spacer plate and is secured in aperture D of plate 104. A U-bend 122 is secured in aperture D of plate 100 and then in aperture E and so on. At the other end length of pipe 130 extends from aperture MM and NN in spacer plate 114 and 116 into aperture NN of plate 104. Outlet pipe 132 extends from aperture NN of plate 100 through housing 70 at 134.

As is evident lengths of pipe 120 are staggered with respect to one another. For controlled expansion or contraction of the lengths of copper pipe, during the heating process using the hot thermal oil heated by the scavengers, each of the lengths of pipe is bowed between the spacer plates into space between the staggered pipes to ensure that any movement of the pipes during expansion and contraction does not cause that pipe to contact any other. With reference to FIGS. 5A, 5B, 5C, 6A, 6A$^1$, 6B, 6B$^1$, 6C, 6C$^1$, and 6D and 6D$^1$, the dispositions of the lengths of copper pipe can be visualized. Because row 1 (See FIGS. 5A, 6A and 6A$^1$) is proximate wall 72 the pipes 120 are bowed in a direction towards wall 76 away from wall 78. Thereafter, pipes in rows 2, 3 and 4, are bowed towards wall 74 into the spaces between adjacent lengths of pipe in the next row.

In operation, each heat exchanger 38 receives heated oil from the scavenger in the cavity between fixed head plates 100 and 102 and bathes the lengths of copper pipe as the paint passes through. U-bends 122 and securably removable plates 104 and 106 have been insulated to minimize heat loss through the metal from the oil and the paint. As the copper pipe is heated and cooled, it wants to and does, expand and contract. However, because each pipe is silver soldered to the plates and spacer plates, short distance from the heat plates, substantially all expansion or contraction occurs at the bowed portions of the pipe between the spacer plates. Because the pipes are bowed, the contraction and expansion of the pipes is controlled and contained in the spaces created between the staggered rows of pipes. The silver solder by its nature is able to withstand the extremes of temperature in the joint while maintaining the connection.

For cleaning, removable plates 104 and 106 are removed exposing the lengths of tubing and U-bends for easy cleaning.

As many changes can be made to the preferred embodiment of the invention without departing from the scope of the invention, it is intended that all matter contained herein be interpreted as illustrative thereof and not in a limiting sense.

The embodiments of the invention in which an exclusive property or privilege is claimed are as follows:

1. A heat exchanger comprising a housing defining a cavity therein, the housing having an inlet and outlet for feeding fluid into, and removing fluid from, the cavity of the housing, a pair of fixed spaced head plates fixed to the housing at either end of the cavity to preclude passage of fluid past the plates between the housing and plates, a pair of second head plates, one for each fixed head plate and secured to the side of the fixed head plate remote the other fixed spaced head plate, at least one of which second plates being removably secured to the fixed head plates, a gasket positioned between the fixed head plates and second plates, the housing further comprising covers for covering the head plates and providing a space between the head plates and cover, a pair of spacer plates secured to the housing between the fixed head plates, each spacer plate positioned adjacent each fixed head plate, the spacer plates permitting fluid within the cavity to flow therethrough, each of the fixed and secured removable head plates having a plurality of aligned apertures therethrough, the apertures being arranged in staggered rows of apertures through the plates, each spacer plate adjacent each set of head plates having staggered rows. of apertures oriented with respect to the staggered rows of apertures in the head plates and the staggered row of apertures through the other spacer plates to secure lengths of tubing extending between opposed head plates, through apertures in the spacer plates, lengths of heat conducting metal tubing secured to open into the staggered apertures in the opposed head plates and extending through the apertures in the spacer plates to provide staggered rows of tubing, the tubing being bowed in their length between the spacer plates to extend into spaces created in the cavity arising from the staggering of the rows of tubing, so as not to interfere with one another during the tubings' expansion, 180° heat conducting metal U-bends secured in the spaces between the removably secured head plates and cover for connecting the apertures through the removable head plates to connect the lengths of tubing to create a continuous flow path for fluid passing therethrough, from the tubing inlet to the tubing outlet leading into and out of the heat exchanger and an inlet and outlet into and from the tubing passing through the exchanger.

2. The heat exchanger of claim 1, wherein the gasket is made of asbestos and vitron rubber.

3. The heat exchanger of claim 1, wherein apertures of the head plates into which the tubing and U-bends are connected have internal ledges extending radially inwardly from the aperture wall, the ledges having a width about the thickness of the tubing and U-Bends against which the tubing and U-bends abut when secured to the head plates.

4. The heat exchanger of claim 1, wherein the tubing and U-Bends are made of copper or a copper alloy.

5. The heat exchanger of claim 4, wherein apertures of the head plates into which the tubing and U-bends are connected have internal ledges extending radially inwardly from the aperture wall, the ledges having a width about the thickness of the tubing and U-bends against which the tubing and U-bends abut when secured to the head plates.

6. The heat exchanger of claim 3, wherein the tubing and U-bends are silver or copper phosphate soldered to the head plates.

7. The heat exchanger of claim 6, wherein apertures of the head plates into which the tubing and U-bends are connected have internal ledges extending radially inwardly from the aperture wall, the ledges having a width about the thickness of the tubing and U-bends against which the tubing and U-bends abut when secured to the head plates.

8. The heat exchanger of claim 5, wherein the tubing is silver or copper phosphate soldered to the spacer plates.

9. The heat exchanger of claim 7 wherein an arcuate portion of the tubing is soldered to the spacer plates.

10. The exchanger of claim 8, wherein the gasket is made of asbestos and vitron rubber.

11. The heat exchanger of claim 8 wherein apertures of the head plates into which the tubing and U-bends are connected have internal ledges extending radially inwardly from the aperture wall, the ledges having a width about the thickness of the tubing and U-bends against which the tubing and U-bends abut when secured to the head plates.

12. The heat exchanger of claim 1, wherein both second plates are removably secured to the fixed head plates.

13. The heat exchanger of claim 12, wherein apertures of the head plates into which the tubing and U-bends are connected have internal ledges extending radially inwardly from the aperture wall, the ledges having a width about the thickness of the tubing and U-Bends against which the tubing and U-bends abut when secured to the head plates.

14. The heat exchanger of claim 2, wherein the tubing and U-Bends are made of copper or a copper alloy.

15. The heat exchanger of claim 14, wherein the gasket is made of asbestos and vitron rubber.

16. The heat exchanger of claim 14, wherein apertures of the head plates into which the tubing and U-bends are connected having internal ledges extending radially inwardly from the aperture wall, the ledges having a width about the thickness of the tubing and U-bends against which the tubing and U-bends abut when secured to the head plates.

17. The heat exchanger of claim 4, wherein the tubing and U-bends are silver or copper phosphate soldered to the head plates.

18. The heat exchanger of claim 17, wherein apertures of the head plates into which the tubing and U-bends are connected have internal ledges extending radially inwardly from the aperture wall, the ledges having a width about the thickness of the tubing and U-bends against which the tubing and U-bends abut when secured to the head plates.

19. The heat exchanger of claim 6, wherein the tubing is silver or copper phosphate soldered to the spacer plates.

20. The heat exchanger of claim 8, wherein an arcuate portion of the tubing is soldered to the spacer plates.

21. The heat exchanger of claim 19, wherein apertures of the head plates into which the tubing and U-bends are connected have internal ledges extending radially inwardly from the aperture wall, the ledges having a width about the thickness of the tubing and U-bends against which the tubing and U-bends abut when secured to the head plates.

22. The heat exchanger of claim 19, wherein apertures of the head plates into which the tubing and U-bends are connected have internal ledges extending radially inwardly from the aperture wall, the ledges having a width about the thickness of the tubing and U-bends against which the tubing and U-bends abut when secured to the head plates.

23. A heat exchanger comprising a housing defining a cavity therein, the housing having an inlet and outlet for feeding fluid into, and removing fluid from, the cavity of the housing, a pair of fixed spaced head plates fixed to the housing at either end of the cavity to preclude the passage of fluid past the plates between the housing and plates, a pair of removable head plates, one for each fixed head plate and being removably secured to the side of the fixed head plate remote the other fixed spaced head plate, a gasket positioned between the fixed head plates and second plates, the housing further comprising covers for covering the head plates and providing a space between the head plates and cover, a pair of spacer plates secured to the housing between the fixed head plates, each spacer plate positioned adjacent each fixed head plate, the spacer plates permitting fluid within the cavity to flow therethrough, each of the fixed and secured removable head plates having a plurality of aligned apertures therethrough, the apertures being arranged in staggered rows of apertures through the plates, each spacer plate adjacent each set of head plates having staggered rows of apertures oriented with respect to the staggered rows of apertures in the head plates and the staggered row of apertures through the other spacer plate to secure lengths of tubing extending between opposed head plates, through apertures in the spacer plates, lengths of copper or copper alloy tubing secured to open into the staggered apertures in the opposed head plates and extending through the apertures in the spacer plates, to provide staggered rows of tubing, the tubing being bowed in their length between the spacer plates to extend into spaces created in the cavity arising from the staggering of the rows of tubing, so as not to interfere with one another during the tubings' expansion 180° U-bends secured in the spaces between the removably secured head plates and cover for connecting the apertures through the removable head plates to connect the lengths of tubing to create a continuous flow path for fluid passing therethrough, from the tubing inlet to the tubing outlet leading into and out of the heat exchanger and an inlet and outlet into and from the tubing passing through the exchanger.

24. The heat exchanger of claim 23, wherein the gasket is made of asbestos and vitron rubber.

25. The heat exchanger of claim 23, wherein the apertures of the head plates into which the tubing and U-bends are connected have internal ledges extending radially inwardly from the aperture wall, the ledges having a width about the thickness of the tubing and U-bends against which the tubing and U-bends abut when secured to the head plates.

26. The heat exchanger of claim 17, wherein the tubing and U-bends are silver or copper phosphate soldered to the head plates.

27. The heat exchanger of claim 26, wherein the apertures of the head plates into which the tubing and U-bends are connected have internal ledges extending radially inwardly from the aperture wall, the ledges having a width about the thickness of the tubing and U-bends against which the tubing and U-bends abut when secured to the head plates.

28. The heat exchanger of claim 18, wherein the tubing is silver or copper phosphate soldered to the spacer plates.

29. The heat exchanger of claim 19, wherein an arcuate portion of the tubing is soldered to the spacer plates.

30. The heat exchanger of claim 28, wherein the aperture of the head plates into which the tubing and U-bends are connected have internal ledges extending radially inwardly from the aperture wall, the ledges having a width about the thickness of the tubing and U-bends against which the tubing and U-bends about when secured to the head plates.

* * * * *